US005643012A

United States Patent [19]

Mai et al.

[11] Patent Number: 5,643,012

[45] Date of Patent: Jul. 1, 1997

[54] SAFETY PLUG WITH SWITCH MEANS

[76] Inventors: Chao-Lin Mai, No. 1, Alley 2, Lane 94, Po Ai Street, Hsinchu City; Pen-Li Chiu, No. 72, Alley 6, Lane 315, Chung Chang North Rd., Sanchung City, Taipei Hsien, both of Taiwan

[21] Appl. No.: 625,416

[22] Filed: Mar. 29, 1996

[51] Int. Cl.[6] ..... H01R 13/68

[52] U.S. Cl. ..... 439/622; 439/621; 200/51 R

[58] Field of Search ..... 439/621, 622, 439/188; 200/51.12, 51 R, 559

[56] References Cited

U.S. PATENT DOCUMENTS

| | | | |
|---|---|---|---|
| 2,259,359 | 10/1941 | Thompson | 200/51 R |
| 2,277,216 | 3/1942 | Epstein | 200/51 R |
| 3,324,260 | 6/1967 | Schumacher | 200/51 R |
| 4,167,658 | 9/1979 | Sherman | 200/51 R |
| 4,484,185 | 11/1984 | Graves | 439/622 |
| 5,435,755 | 7/1995 | Chien et al. | 439/622 |
| 5,451,173 | 9/1995 | Mai | 439/622 |

*Primary Examiner*—David L. Pirlot
*Assistant Examiner*—Tho Dac Ta
*Attorney, Agent, or Firm*—Varndell Legal Group

[57] ABSTRACT

A safety plug which includes a first metal contact plate and a second metal contact plate respectively connected to the two conductors of an electric wire, and a first metal blade and a second metal blade for connection to an electric power outlet. A cartridge fuse is connected between the second metal contact plate and the second metal blade. A switch is controlled to force the first metal contact plate into contact with the first metal blade to close the circuit. A base is mounted within a housing to hold the above members therein which has a rear panel and two plug holes on the rear panel for the insertion of an external electric plug for connection the first metal blade and the second metal blade, and a slide controlled to close/open the plug holes of the rear panel.

8 Claims, 19 Drawing Sheets

SAFETY PLUG WITH SWITCH MEANS

BACKGROUND AND SUMMARY OF THE INVENTION

The present invention relates to electric plugs, and relates more particularly to such an electric plug which has a switch controlled to close/open the circuit.

A regular electric plug is generally comprised of a housing, a base mounted in the housing, two metal contact plates mounted inside the base and respectively connected to the two conductors of an electric wire, and two metal plates respectively connected to the metal contact plates and extending out of the base and the housing for connection to an electric power outlet. This structure of electric plug is not safe in use because it can not protect against an overload. In order to protect against an overload, fuse means may be installed. There is also known an electric plug having two plug holes at the rear end for the connection of an external electric plug. However, because the plug holes at the rear end of the electric plug are exposed to the outside, a child may insert a metal object into the plug holes to close the circuit, causing an electric shock.

According to one aspect of the present invention, the safety plug comprises a first metal contact plate and a second metal contact plate respectively connected to the two conductors of an electric wire, a first metal blade and a second metal blade for connection to an electric power outlet, a cartridge fuse connected between the second metal contact plate and the second metal blade, a switch controlled to force the first metal contact plate into contact with the first metal blade to close the circuit, and a base mounted within a housing to hold the aforesaid members on the inside. According to another aspect of the present invention, the base has a rear panel, and two plug holes on the rear panel for the insertion of an external electric plug to connect the first metal blade and the second metal blade. According to still another aspect of the present invention, a slide is mounted in the housing and moved to close/open the plug holes of the rear panel of the base.

BRIEF DESCRIPTION OF THE DRAWINGS

FIG. 25 is an exploded view of the alternate form of the third embodiment according to the present invention.

DETAILED DESCRIPTION OF THE PREFERRED EMBODIMENT

Figure 1:
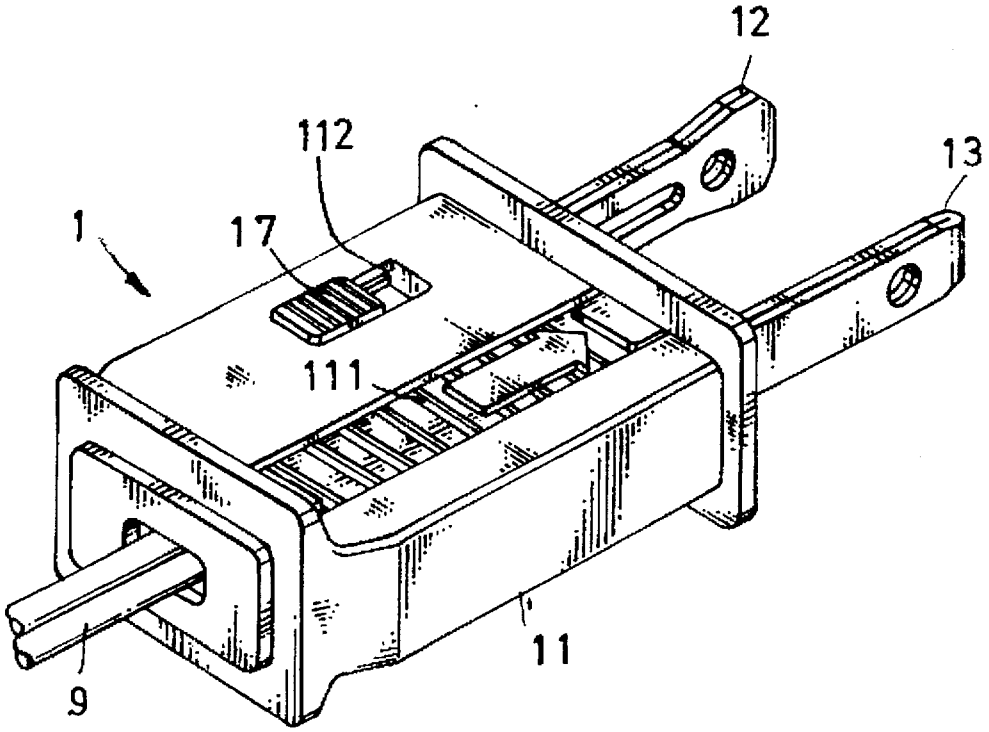
FIG. 1 is an elevational view of a safety plug according to a first embodiment of the present invention.
Figure 2:
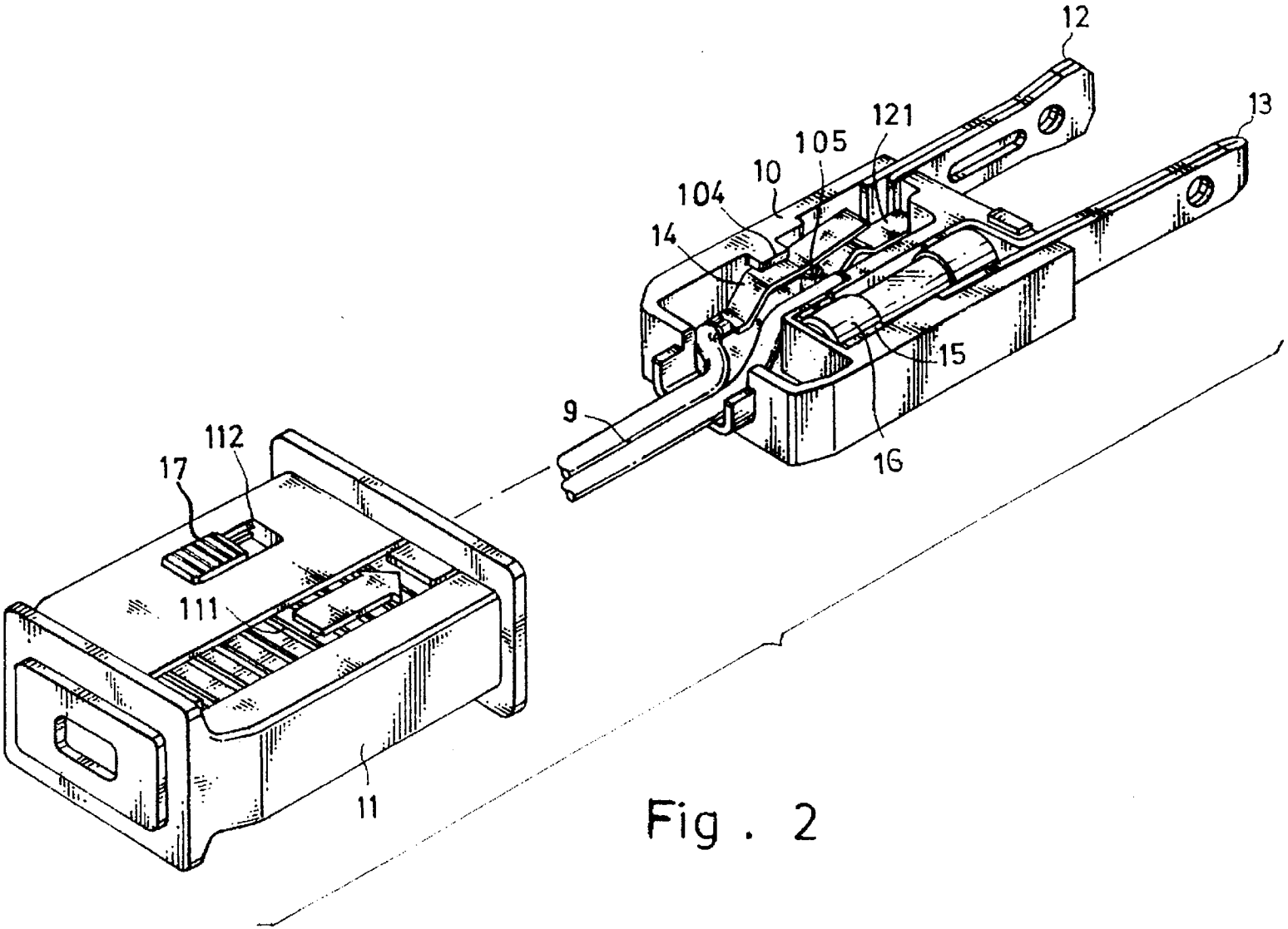
FIG. 2 shows the housing of the safety plug of FIG. 1 removed from the base thereof.
Figures 3, 4:
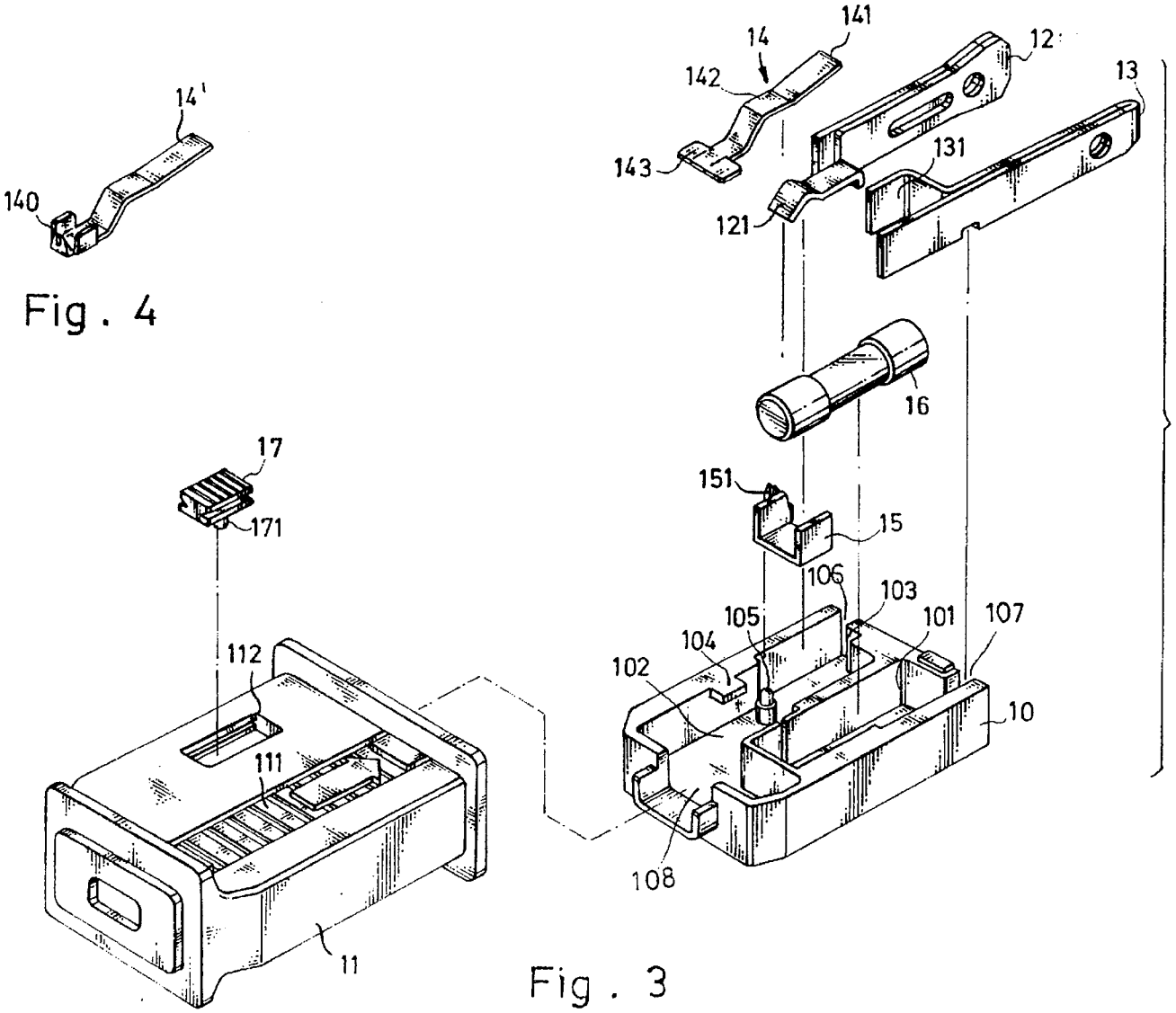
FIG. 3 is an exploded view of the safety plug of FIG. 1.
FIG. 4 shows an alternate form of the first metal contact plate according to the first embodiment of the present invention.
Figure 6:
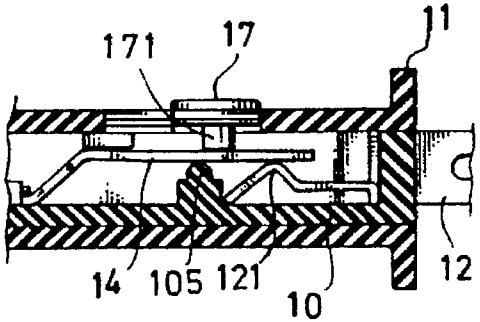
FIG. 6 is another sectional view of the safety plug shown in FIG. 1, showing the first metal contact plate forced into contact with the first metal blade.
Figure 7:
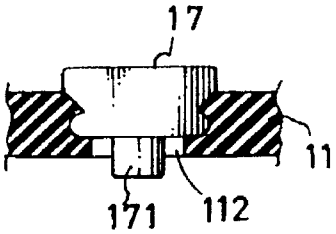
FIG. 7 is a partial view in section of FIG. 1, showing the positioning of the switch in the switch sliding slot.
Figure 5:
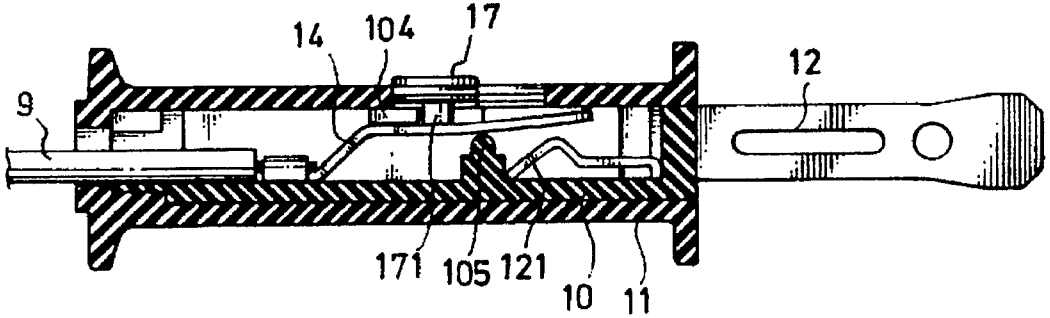
FIG. 5 is a side view in section of the safety plug shown in FIG. 1.
Figure 8:
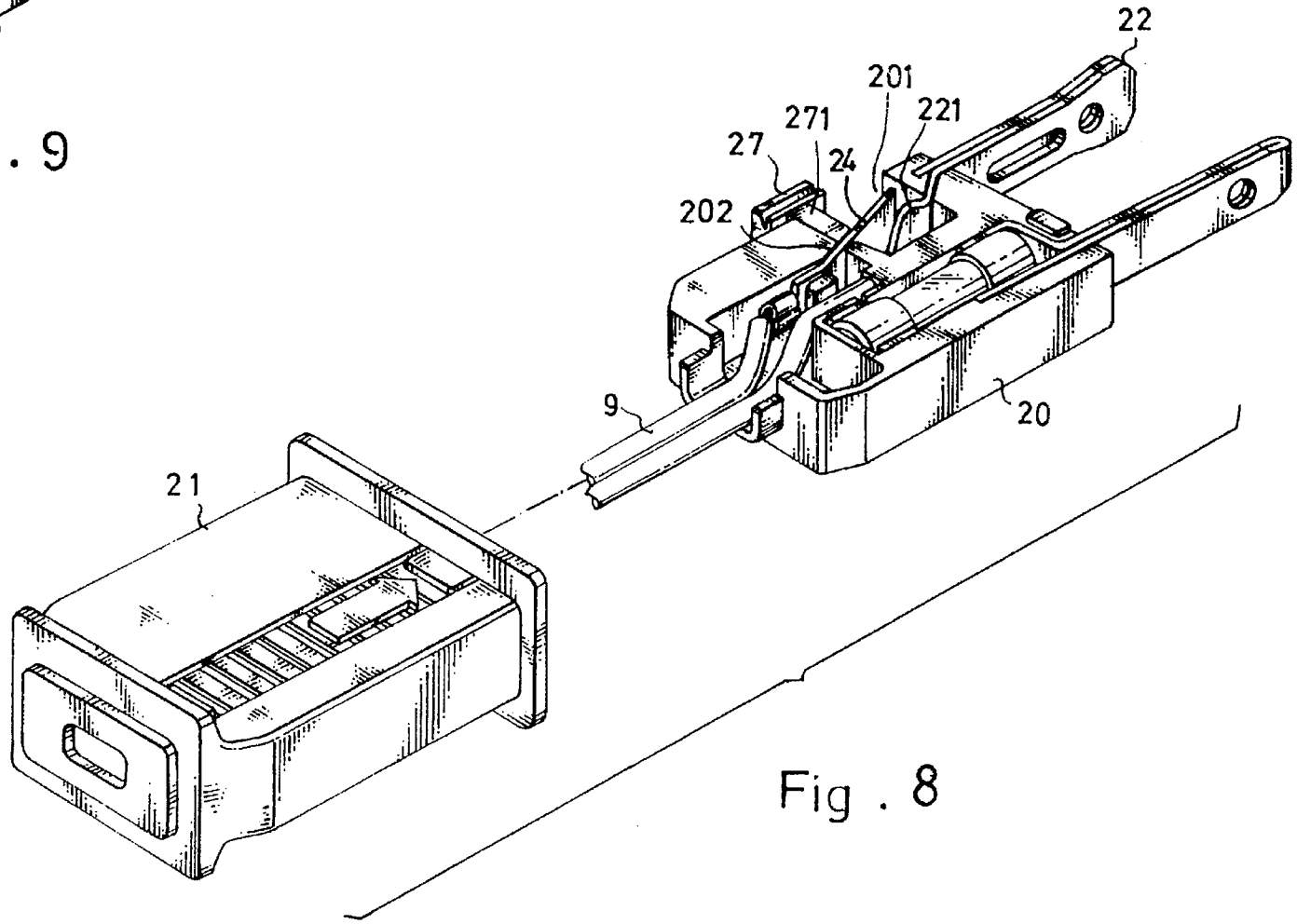
FIG. 8 shows a safety plug according to a second embodiment of the present invention.

Referring to FIGS. 1 to 7, the safety plug 1, is generally comprised of a base 10, a housing 11, a first metal blade 12, a second metal blade 13, a first metal contact plate 14, a second metal contact plate 15, a cartridge fuse 16, and a switch 17. The base 10 comprises a first longitudinal trough 102, which receives the first metal blade 12 and the first metal contact plate 14, a second longitudinal trough 101, which receives the second metal blade 13 and the second metal contact plate 15, a first front slot 106 for the insertion of the first metal blade 12 into the first longitudinal trough 102, a second front slot 107 for the insertion of the second metal blade 13 into the second longitudinal trough 101, a rear wire hole 108 for the installation of the electric wire 9, a front stop edge 103 adjacent to the first front slot 106, an inward projecting strip 104 transversely projecting into the first longitudinal trough 102 in the middle at the top, and a post 105 in the first longitudinal trough 102. The second metal blade 13 is inserted through the second front slot 107 into the second longitudinal trough 101, having a rear end terminating in a forked coupling portion 131, which receives one end of the cartridge fuse 16. The opposite end of the cartridge fuse 15 is connected to the second metal contact plate 15. The second metal contact plate 15 has a pointed projection 151 forced into contact with one conductor of the electric wire 9. The housing 11 is covered on the base 10, having a longitudinal sliding door 111 and a longitudinal switch sliding slot 112. By opening the sliding door 111, the cartridge fuse 16 can be removed from the base 10 for a replacement. The switch sliding slot 112 is made on the housing 11 in the longitudinal direction. The first metal blade 12 is inserted through the first front slot 106 into the first longitudinal trough 102, having a curved rear contact strip 121 stopped between the front stop edge 103 and the post 105. The first metal contact plate 14 has a front contact tip 141 suspended above the curved rear contact strip 121, a curved middle section 142 supported on the post 105 below the inward projecting strip 104, and a rear connecting tail 143 connected to one conductor of the electric wire 9. The switch 17 is slidably coupled to the switch sliding slot 112 through a dovetail joint, having a downward press rod 171 stopped above the first metal contact plate 14. When the switch 17 is moved forwards, the curved middle section 142 is driven to force the front contact tip into contact with the rear contact strip 121 of the first metal blade 12. When the switch 17 is moved backwards, the curved middle section 142 of the first metal contact plate 14 immediately returns to its former shape to move the front contact tip upwardly away from the rear contact strip 121 of the first metal blade 12. FIG. 4 shows an alternate form of the first metal contact plate. As illustrated, this alternate form 14' has a pointed projection 140 at the rear end, which pierces the insulator of the electric wire 9 to make contact with one conductor therein.

Figure 9:
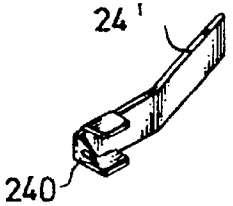
FIG. 9 shows an alternate form of the first metal contact plage according to the second embodiment of the present invention.
Figure 11:
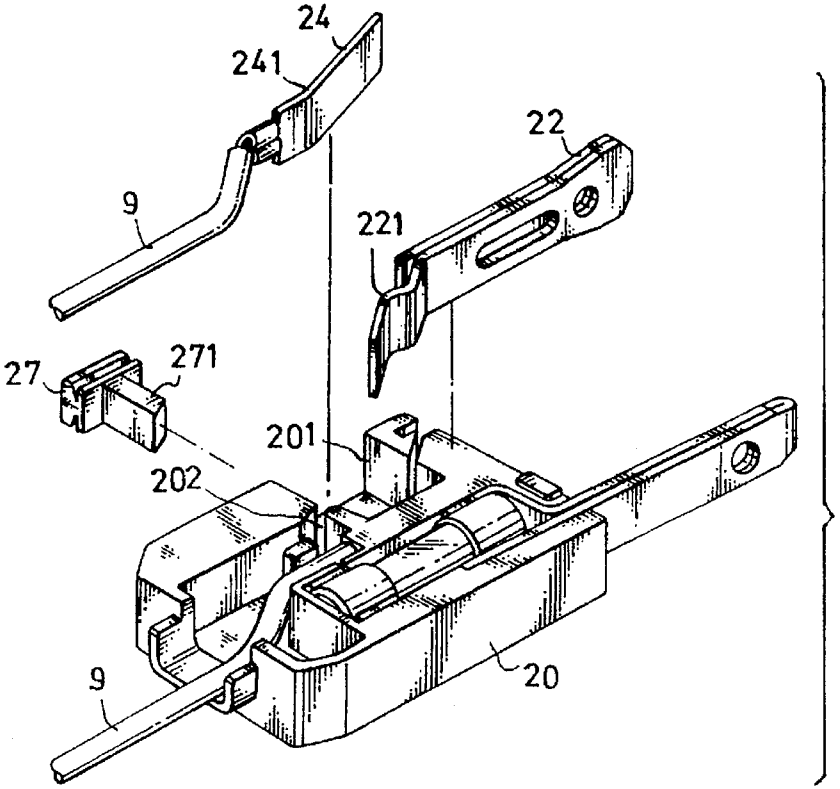
FIG. 11 is an exploded view of the safety plug of the second embodiment according to the present invention.
Figure 10:
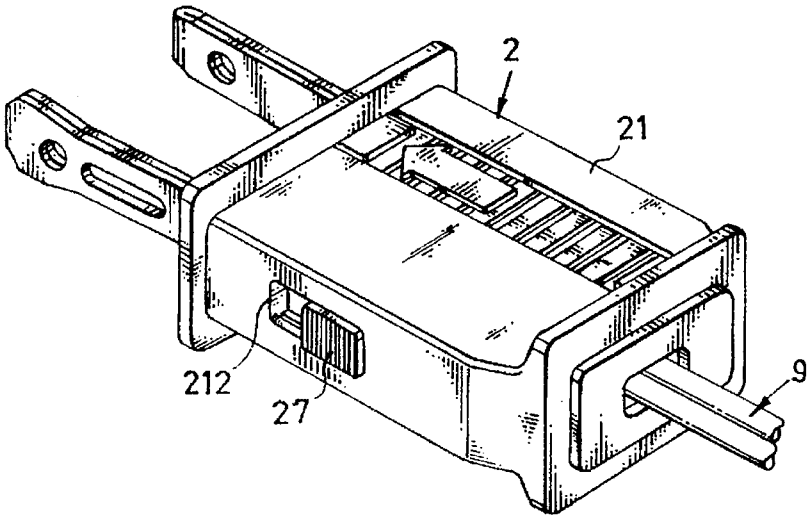
FIG. 10 is an elevational view of the safety plug of the second embodiment according to the present invention.
Figure 13:
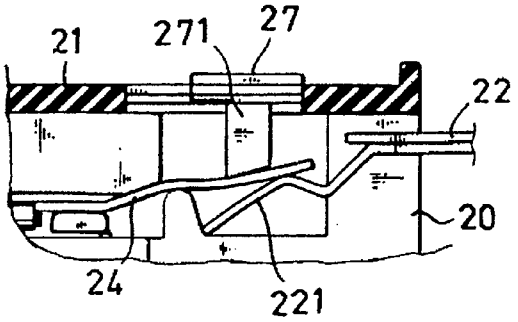
FIG. 13 is a partial view in section of the safety plug shown in FIG. 8, showing the first metal contact plate forced into contact with the first metal blade.
Figure 12:
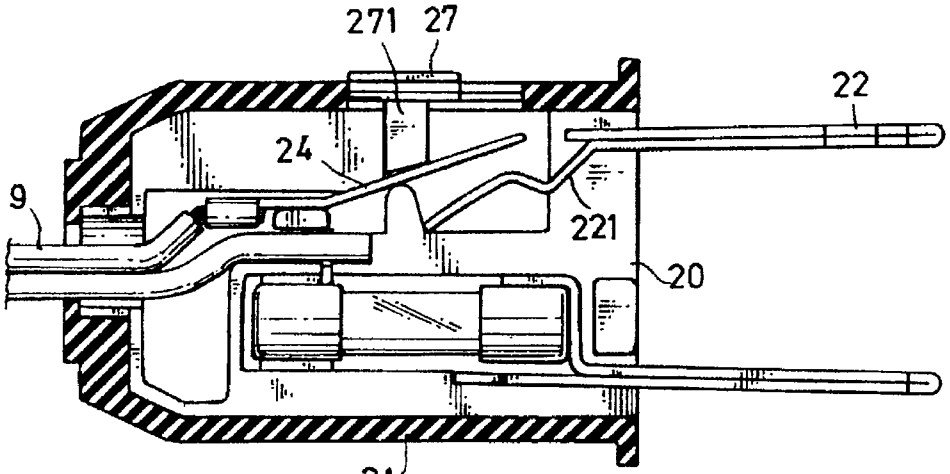
FIG. 12 is a top view in section of the safety plug shown in FIG. 10.
Figure 14:
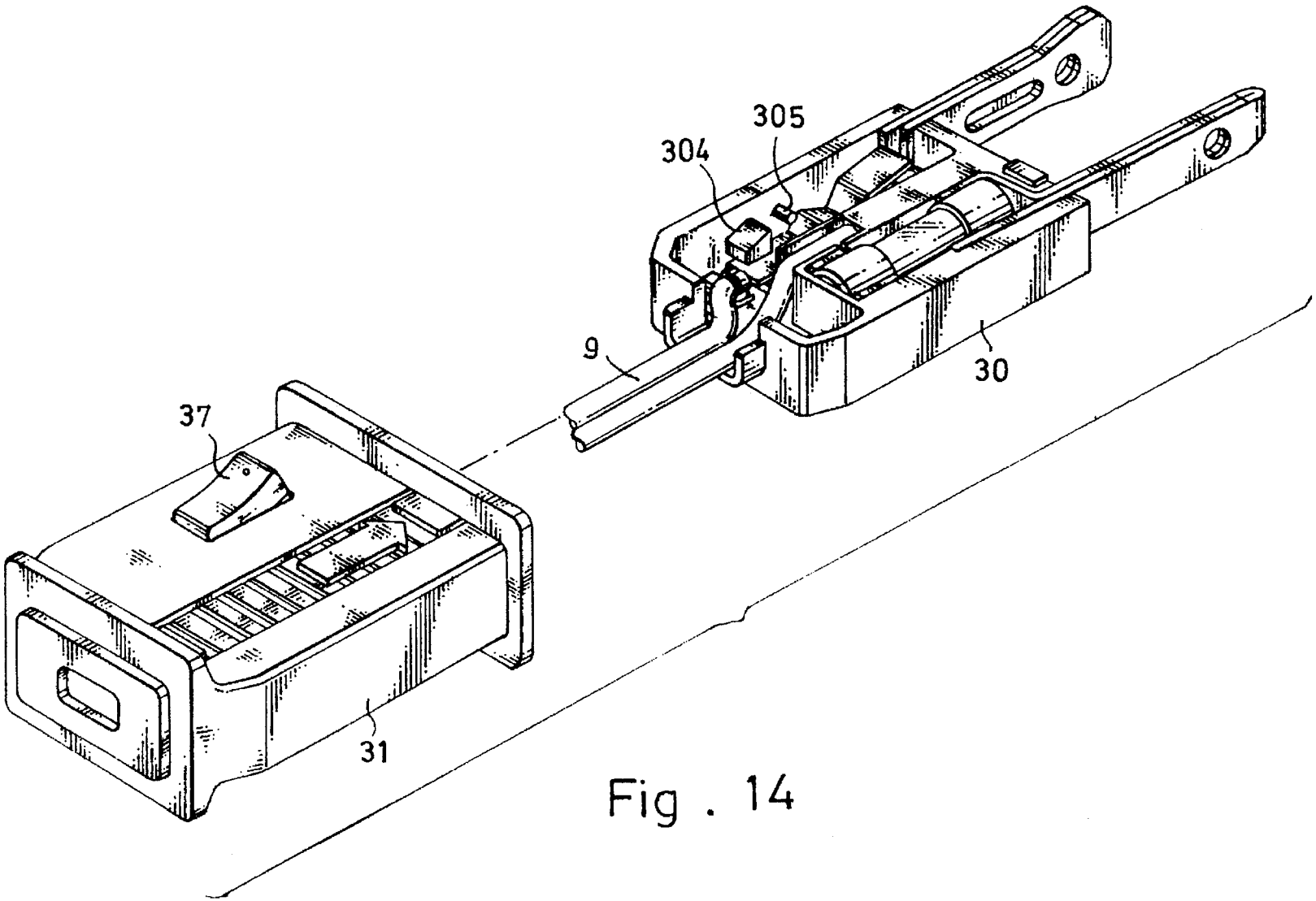
FIG. 14 shows a safety plug according to a third embodiment of the present invention.
Figure 15:
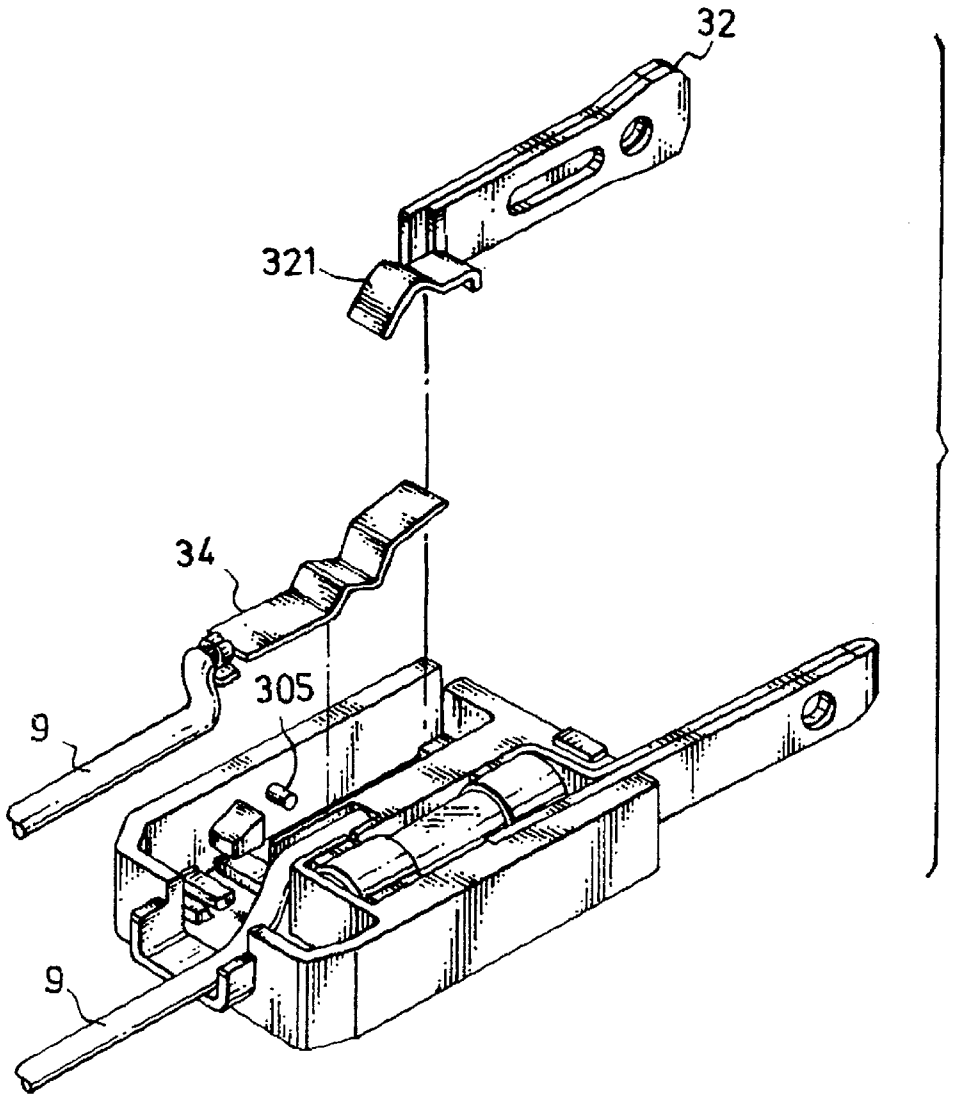
FIG. 15 is an exploded view of the safety plug of the third embodiment according to the present invention.
Figure 17:
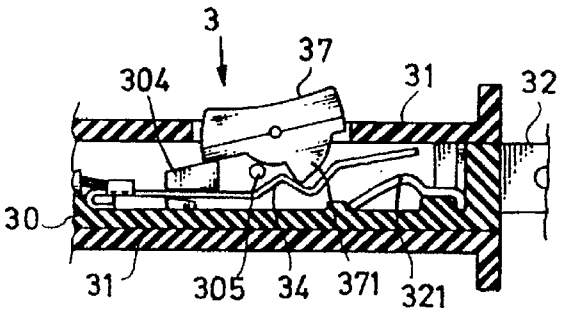
FIG. 17 is similar to FIG. 16 but showing the first metal contact plate forced into contact with the first metal blade.
Figure 16:
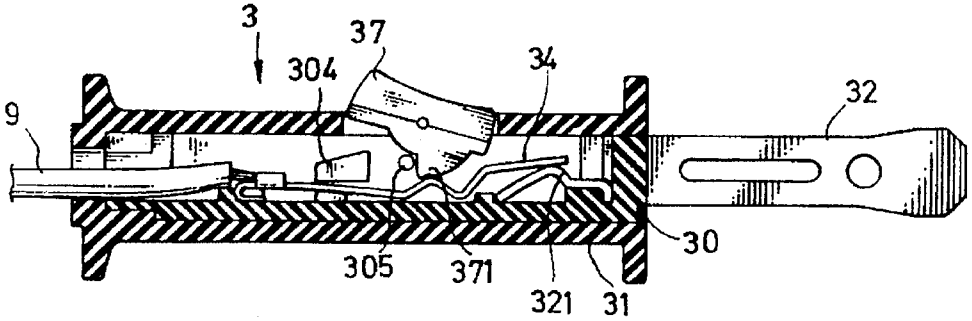
FIG. 16 is a sectional assembly view of the safety plug shown in FIG. 14.
Figure 18:
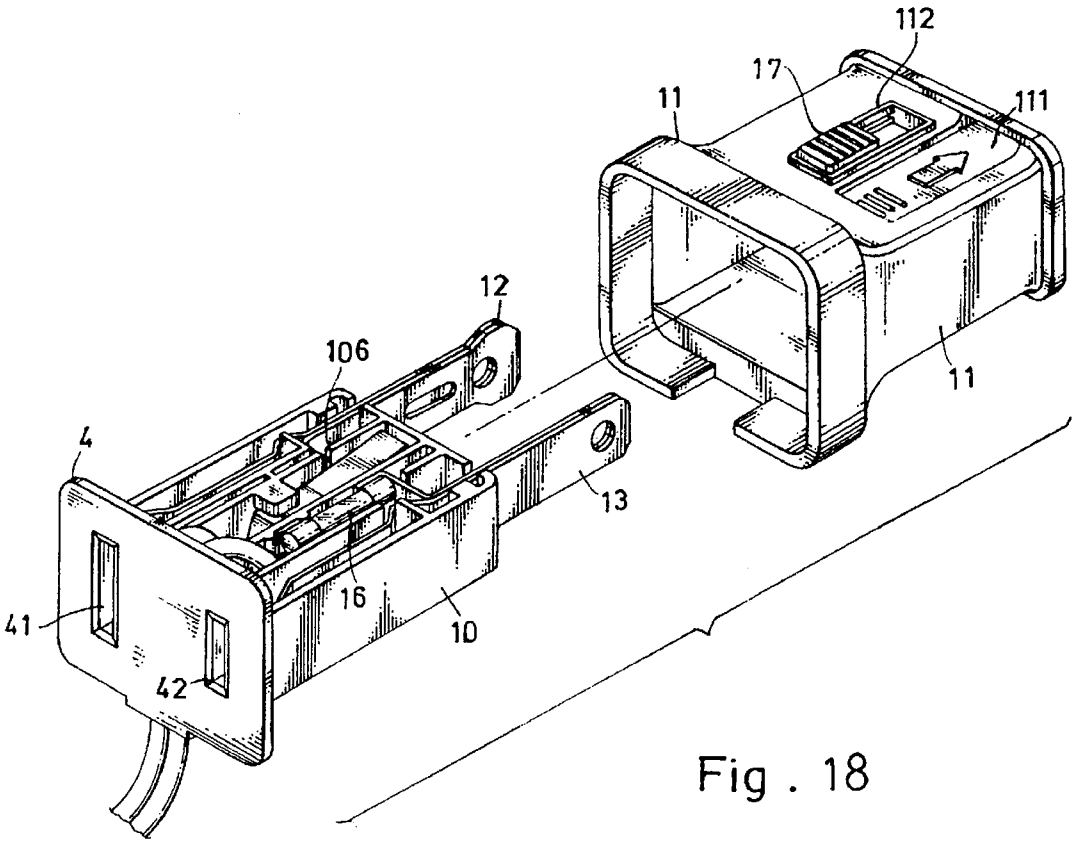
FIG. 18 shows an alternate form of the first embodiment of the present invention.
Figure 19:
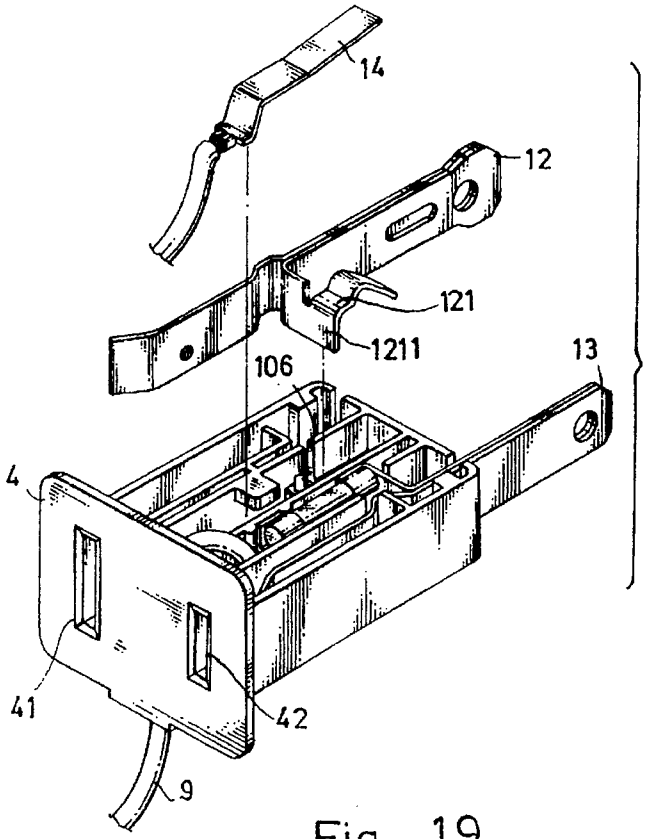
FIG. 19 is an exploded view of the alternate form of FIG. 18.
Figure 20:
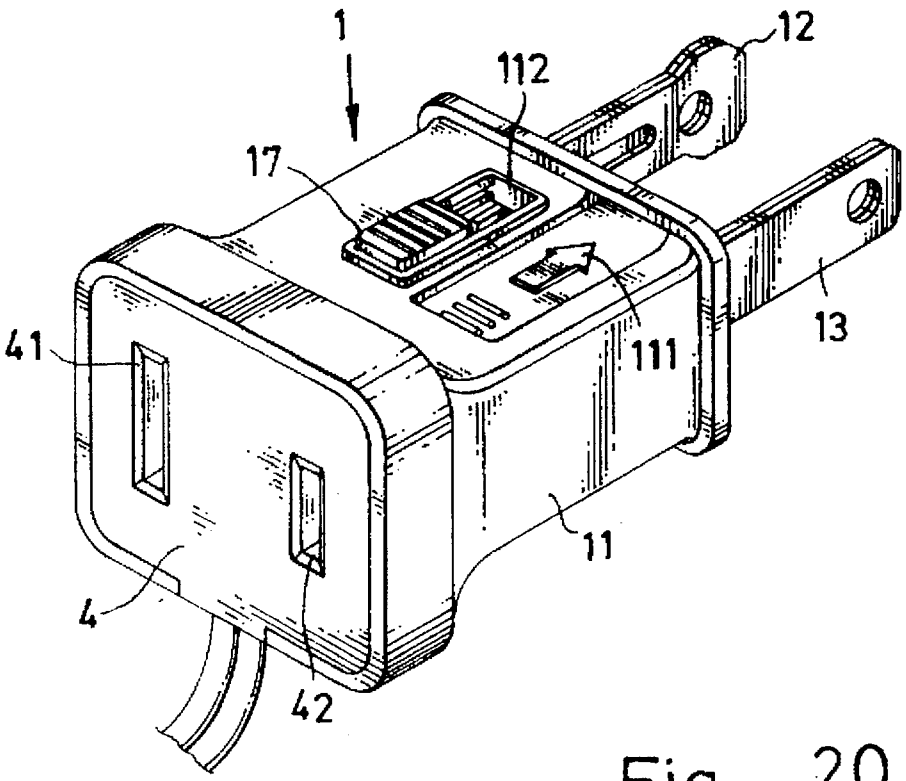
FIG. 20 is an elevational view of the alternate form of FIG. 18.
Figure 22:
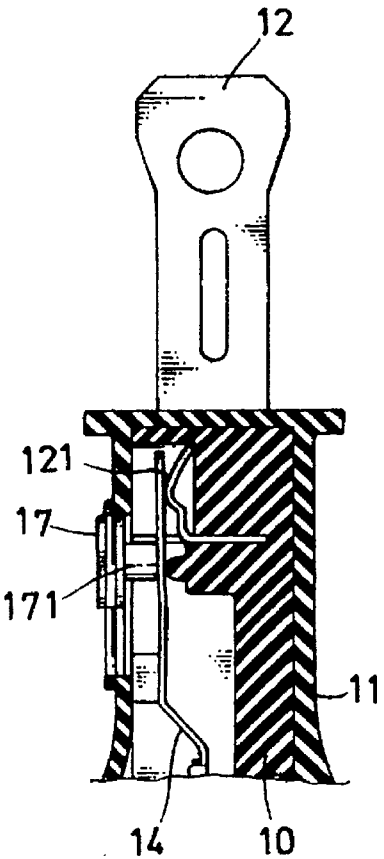
FIG. 22 is similar to FIG. 21 but showing the first metal contact plate forced into contact with the first metal blade.
Figure 23:
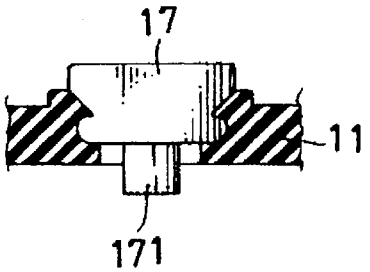
FIG. 23 is a partial view in section of FIG. 22, showing the positioning of the switch.
Figure 21:
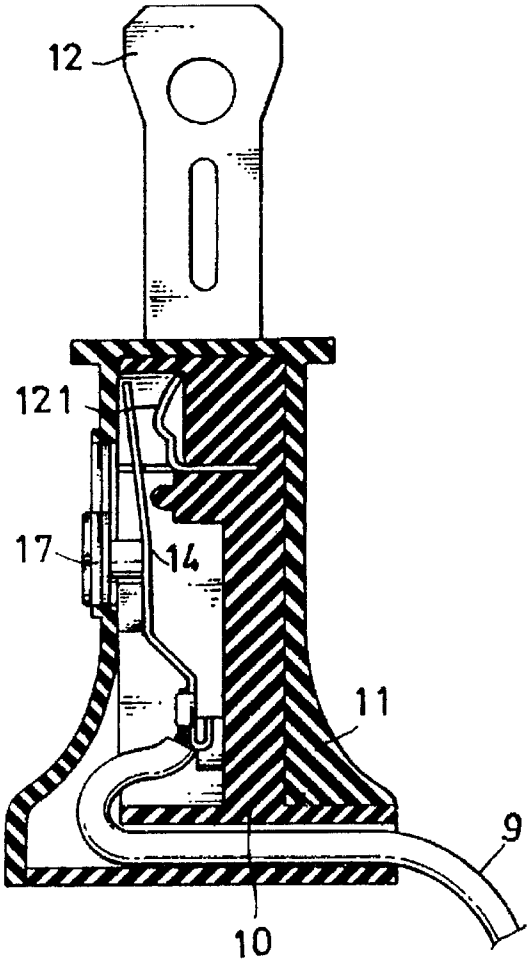
FIG. 21 is a sectional assembly view of the alternate form of FIG. 18.
Figure 24:
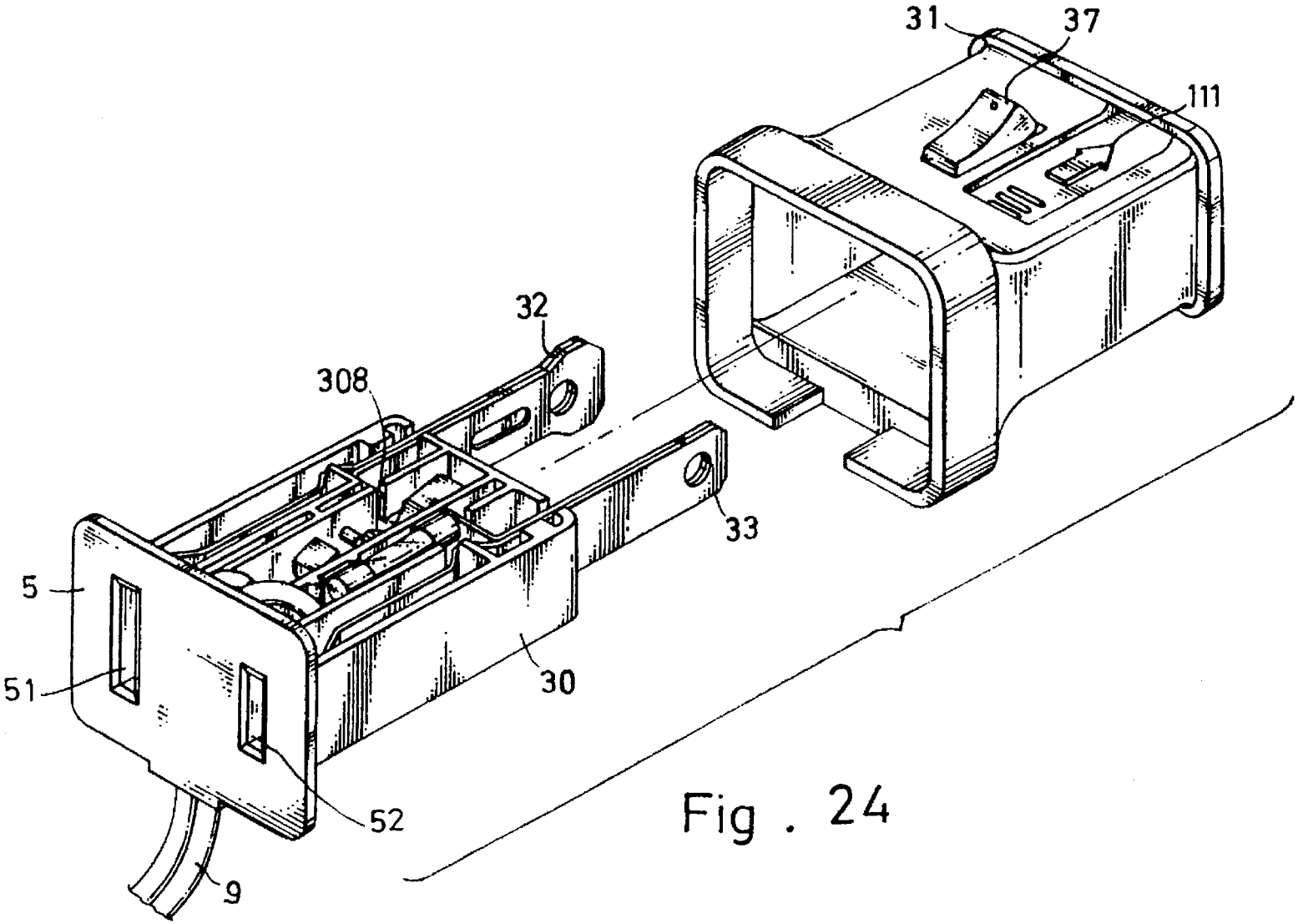
FIG. 24 shows an alternate form of the third embodiment of the present invention.
Figure 25:
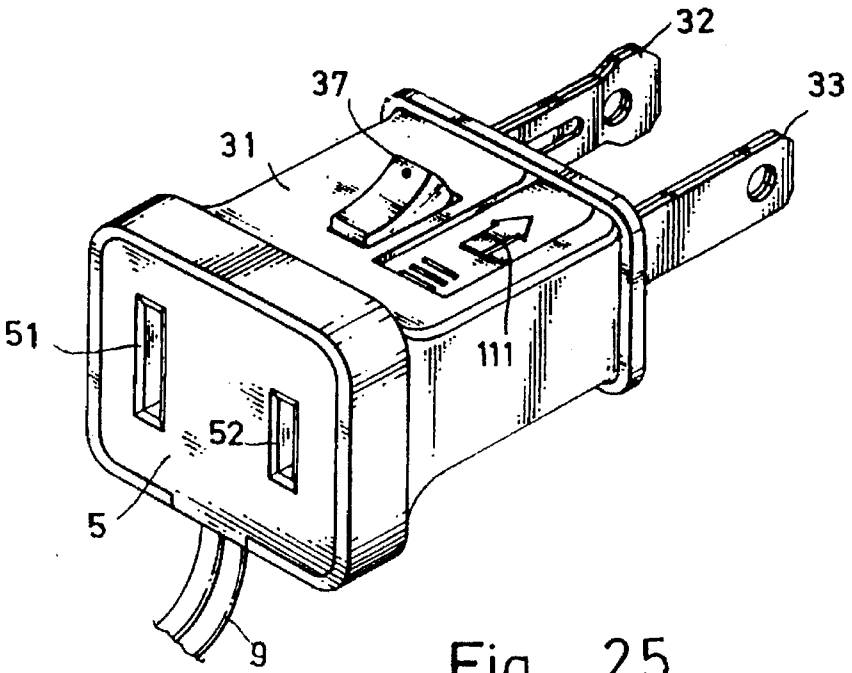
FIG. 25 is an elevational view of the alternate form of the third embodiment according to the present invention.
Figure 26:
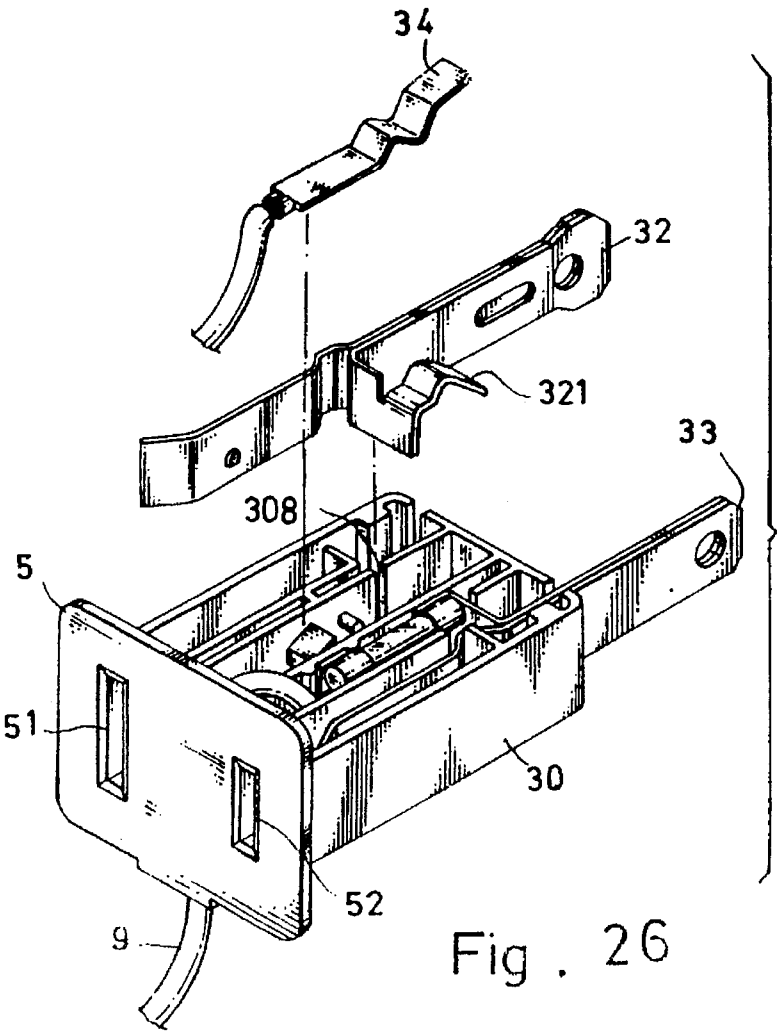
Figure 28:
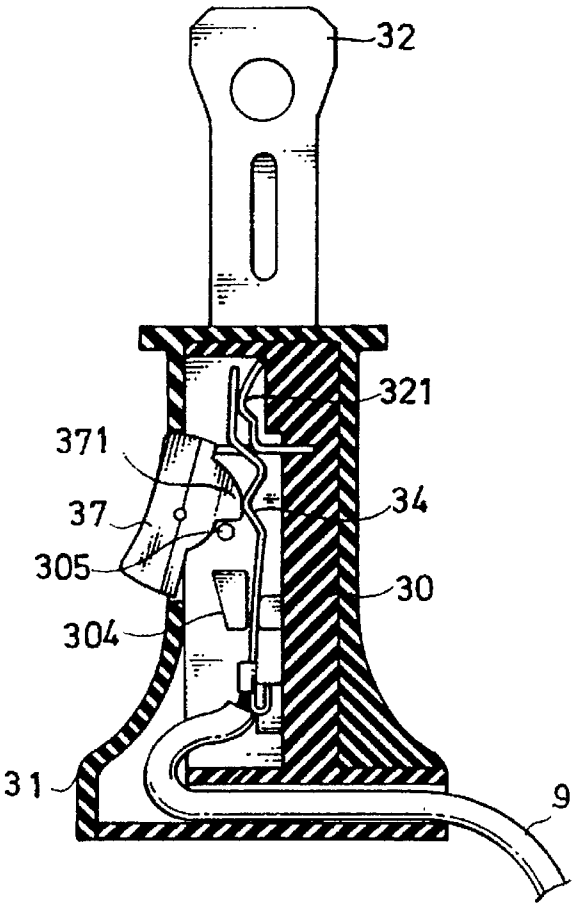
FIG. 28 is a sectional view taken along line 28—28 of FIG. 27.
Figure 27:
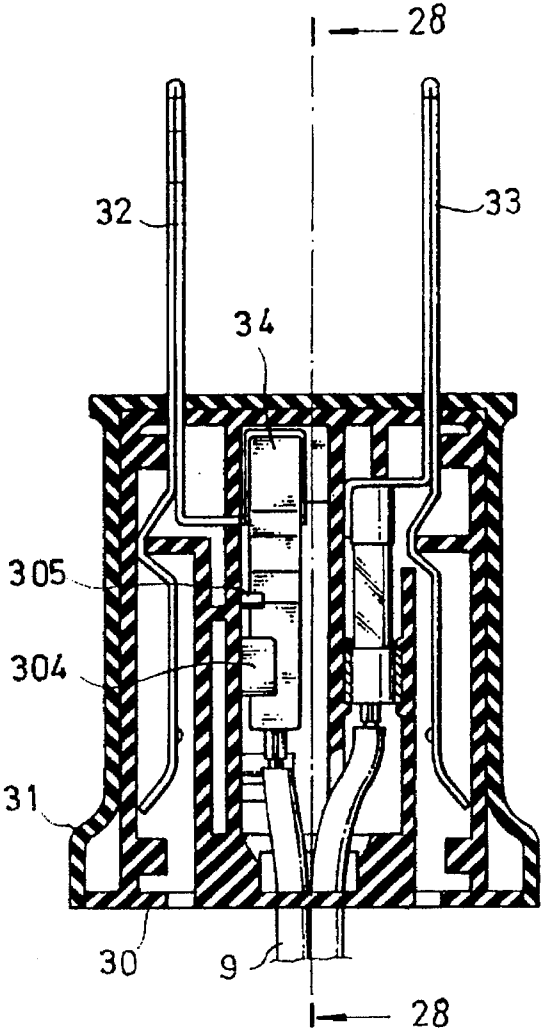
FIG. 27 is a top view in section of FIG. 25.
Figure 29:
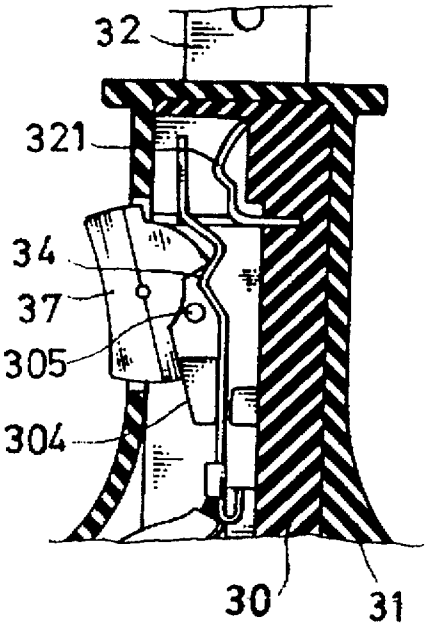
FIG. 29 is similar to FIG. 28 but showing the first metal contact plate disconnected from the first metal blade.
Figure 31:
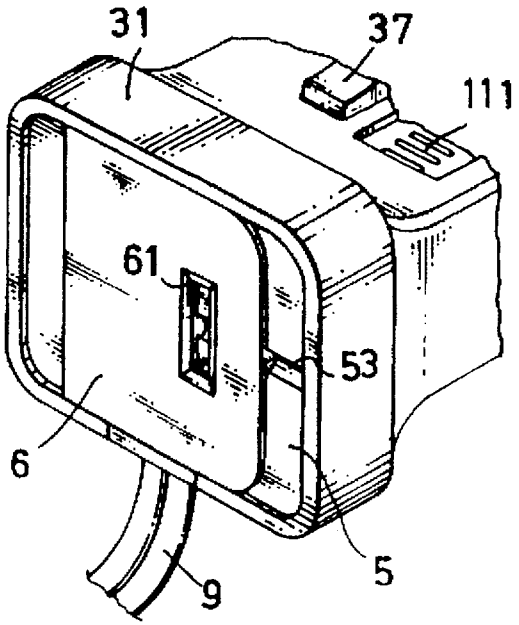
FIG. 31 is similar to FIG. 30 but showing the plug holes of the rear panel of the base closed.
Figure 30:
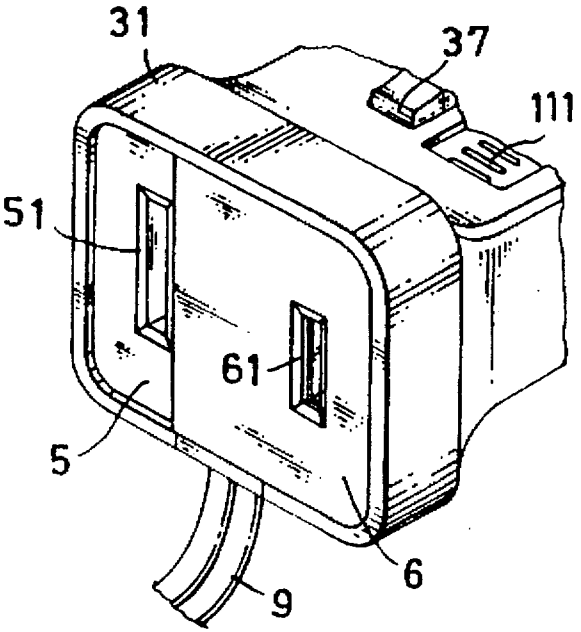
FIG. 30 shows a slide mounted in the housing of the safety plug shown in FIG. 25.
Figure 32:
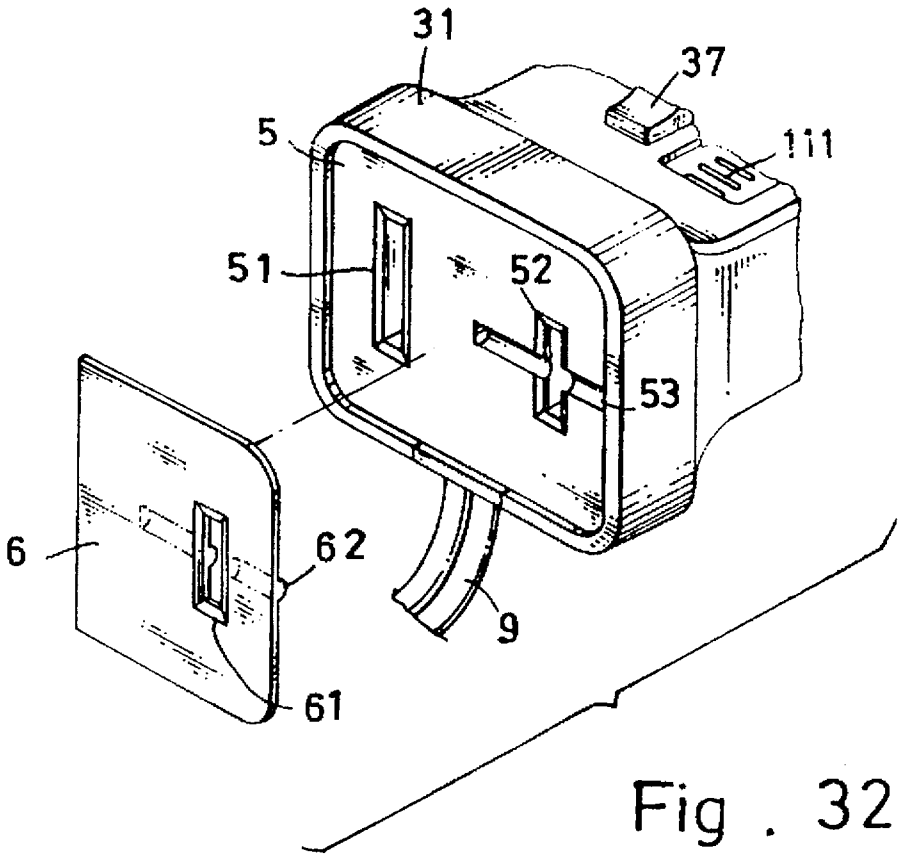
FIG. 32 is an exploded view of FIG. 30.

Figures from 8 to 13 show a safety plug according to a second embodiment of the present invention. As illustrated, the base 20 of the safety plug 2 has a side opening 201, and a gap 202 in communication with the side opening 201; the first metal contact plate 24 is installed in the base 20 in vertical position, having one end connected to the electric wire 9, a bend 241 in the middle, and a front end inserted through the gap 202 and projecting into the side opening 201; the first metal blade 22 is installed in the base 20 in a vertical position, having a curved rear contact strip 221 spaced from the first metal contact plate 24; the switch 27 is slidably mounted in a longitudinal sliding slot 212 at one lateral side of the housing 21, having a press rod 271 pressed on the first metal contact plate 24 and moved with the switch 27 to force the first metal contact plate 24 into contact with the rear contact strip 221 of the first metal blade 22. The alternate form of the first metal contact plate 24' shown in FIG. 9 has a pointed projection 240 for piercing the insulator of the electric wire 9 to make contact with one conductor therein.

Figures from 14 to 17 show a safety plug 3 according to a third embodiment of the present invention. As illustrated, the base 30 has an inward pivot 305 and an inward projecting strip 304; the first metal blade 32 is mounted in the base 30, having a rear contact strip 321; the first metal contact plate 34 is mounted in the base 30 below the inward projecting strip 304 and connected to the electric wire 9, with its front end suspended above the rear contact strip 321 of the first metal blade 32; the switch 37 is a toggle switch turned about the pivot 305 of the base 30 and projecting out of the top side of the housing 31, having a sector-like bottom projection 371. When the switch 37 is turned backwards and stopped at the inward projecting strip 304, the first metal contact plate 34 is released from the first metal blade 32, and therefore the circuit is off; when the switch 37 is turned forwards, the first metal contact plate 34 is forced by the sector-like bottom projection 371 of the switch 37 into contact with the rear contact strip 321 of the first metal blade 32.

Figures from 18 to 23 show an alternate form of the first embodiment of the present invention, in which the base 10 has a rear panel 4 and two plug holes 41, 42 disposed on the rear panel 4 and aligned with the first metal blade 12 and the second metal blade 13 for the connection of an external electric plug; the rear contact strip 121 of the first metal blade 12 curves forwards, having a vertical mounting portion 1211 fastened to a mounting groove 106 inside the base 10.

Figures from 24 to 32 show an alternate form of the third embodiment of the present invention, in which the rear contact strip 321 of the first metal blade 32 is fastened to a mounting groove 308 in the base 30; the base 30 has a rear panel 5 and two plug holes 51, 52 on the rear panel 5 and aligned with the first metal blade 32 and the second metal blade 33 for the connection of an external electric plug; a slide 6 is mounted in the housing 31 and moved on the rear panel 5, having a slot 61, and a back rail 62 moved in a transverse groove 53 on the rear panel 5. When the slide 6 is moved to the left side to align the slot 61 with one plug hole 52, the plug holes 51, 52 are opened for the installation of an external electric plug. When the slide 6 is moved out of the operative position, external metal objects are prohibited from being inserted into the plug holes 51, 52 to close the circuit.

We claim:

1. A safety plug comprising a base having first longitudinal trough and a second longitudinal trough, a first metal contact plate and a first metal blade respectively mounted in said first longitudinal trough, a second metal contact plate and a second metal blade respectively mounted in said second longitudinal trough, a cartridge fuse connected between said second metal contact plate and said second metal blade, a housing covered on said base, and an electric wire having two conductors respectively connected to said first metal contact plate and said second metal contact plate, wherein said first metal blade has a rear contact strip retained inside said first longitudinal trough and spaced from said first metal contact plate; said housing has a switch mounting hole for mounting a switch; said base comprises a post and projecting strip disposed inside said first longitudinal trough to hold said first metal contact plate in a suspended position above the rear contact strip of said first metal blade; a switch is mounted in the switch mounting hole of said housing, having a bottom projection pressed on said first metal contact plate and moved between a first position, in which said first metal contact plate is forced into contact with the rear contact strip of said first metal blade to close the circuit, and a second position, in which said first metal contact plate is released from the rear contact strip of said first metal blade to cut off the circuit.

2. The safety plug of claim 1 wherein said first metal contact plate has a front contact tip suspended above the rear contact strip of said first metal blade, a curved middle section supported on said post below said pojecting strip, and a rear connecting tail connected to said electric wire, said rear connecting tail having a pointed portion forced into contact with one conductor of said electric wire.

3. The safety plug of claim 1 wherein the rear contact strip of said first metal blade is mounted in said first longitudinal trough of said base in a horizontal position and retained between said post and a front stop edge inside said first longitudinal trough of said base; said first metal contact plate is horizontally mounted in said first longitudinal trough of said base and suspending above the rear contact strip of said first metal blade; said switch is mounted in said switch mounting hole above said first longitudinal trough of said base, having a downward press rod pressed on said first metal contact plate.

4. The safety plug of claim 1 wherein the rear contact strip of said first metal blade is mounted in said first longitudinal trough of said base in a vertical position; said base has a side opening and a gap respectively disposed in communication with said first longitudinal trough; said first metal contact plate is mounted in said first longitudinal trough in a vertical positon, having a front contact tip inserted through said gap and said side opening of said base and spaced from the rear contact strip of said first metal blade; said switch is mounted in said switch mounting hole at one side of said side opening of said base, having a horizontal press rod pressed on said first metal contact plate.

5. The safety plug of claim 1 wherein said switch is a sliding switch mounted in the switch mounting hole of said housing by a dovetail joint.

6. The safety plug of claim 1 wherein said switch is a toggle switch mounted in the switch mounting hole of said housing and turned about a horizontal pivot inside said base.

7. The safety plug of claim 1 wherein said base has a rear panel at one end, and two plug holes disposed on said rear panel and respectively aligned with said first metal blade and said second metal blade for the insertion of an external electric plug into contact with said first metal blade and said second metal plate.

8. The safety plug of claim 7 further comprising a slide mounted in said housing and moved on said rear panel between a first position in which said plug holes are closed, and a second position in which said plug holes are opened.

* * * * *